United States Patent [19]

Wendschlag et al.

[11] Patent Number: 4,832,068

[45] Date of Patent: May 23, 1989

[54] LIQUID/GAS BYPASS

[75] Inventors: James C. Wendschlag, Pueblo, Colo.; James W. Larson, La Crosse, Wis.

[73] Assignee: American Standard Inc., New York, N.Y.

[21] Appl. No.: 135,786

[22] Filed: Dec. 21, 1987

[51] Int. Cl.[4] ..... F25B 41/04

[52] U.S. Cl. ..... 62/197; 62/117; 62/218

[58] Field of Search ..... 62/197, 117, 196.1, 62/205, 218, 511

[56] References Cited

U.S. PATENT DOCUMENTS

| | | | |
|---|---|---|---|
| 2,075,647 | 3/1937 | Hibberd | 62/115 |
| 2,564,310 | 8/1951 | Nussbaum et al. | 62/3 |
| 2,991,632 | 7/1961 | Rogers | 62/498 |
| 3,150,502 | 9/1964 | Tucker | 62/197 |
| 3,161,029 | 12/1964 | Macrow | 62/197 |
| 3,210,955 | 10/1965 | Anderson et al. | 62/197 X |
| 3,232,074 | 1/1966 | Weller et al. | 62/117 X |
| 3,241,331 | 3/1966 | Endress et al. | 62/117 X |
| 3,402,563 | 9/1968 | Endress | 62/117 |
| 3,791,160 | 2/1974 | Savitz et al. | 62/196 |
| 4,718,245 | 1/1988 | Van Steenburgh, Jr. | 62/197 X |

*Primary Examiner*—Harry B. Tanner

*Attorney, Agent, or Firm*—William J. Beres; David L. Polsley; Robert J. Harter

[57] ABSTRACT

A liquid/gas bypass line bypasses an expansion device of a refrigeration apparatus. An inlet of the bypass line is connected slightly above the bottom of a condenser so that it can pass either liquid refrigerant or vaporous refrigerant, depending on the level of liquid refrigerant in the condenser. The other end of the bypass line is connected to discharge into the evaporator, bypassing the expansion device. The bypass line functions as a conventional hot gas bypass during low load conditions when the level of liquid refrigerant is below the line's inlet. When the level rises above the inlet, often occurring when the condenser coolant temperature is low and the compressor is fully loaded, the bypass line returns excess accumulated liquid refrigerant to the evaporator. Maintaining the proper levels of liquid refrigerant in both the condenser and the evaporator not only provides the most effective use of their heat transfer surfaces, but also promotes the proper return of oil to the compressor.

40 Claims, 16 Drawing Sheets

LIQUID/GAS BYPASS

TECHNICAL FIELD

The subject invention generally pertains to a refrigeration apparatus having a bypass line that directly connects a condenser to an evaporator, bypassing an expansion device, and more specifically pertains to the bypass line which regulates the level of liquid refrigerant in both the condenser and evaporator, provides a passage for hot gas bypass, and facilitates adequate oil return to a refrigeration compressor.

BACKGROUND OF THE INVENTION

Refrigeration systems are often subject to changing operating conditions. In particular, the temperature of the system's coolant (water or outside air), and the temperature conditioning demand may vary. As the temperature conditioning demand varies, the system's compressor is usually controlled to operate between a fully to partially loaded condition to meet the demand. When the demand is very low, however, the compressor is typically cycled on and off. In some cases, excessive cycling may decrease the life of the compressor, and low load conditions may cause inadequate oil return to the compressor.

In many systems, excessive cycling is reduced by employing a hot gas bypass line. During periods of low load conditions, the hot gas bypass conveys relatively hot vaporous refrigerant directly from the condenser to the evaporator, bypassing the system's expansion device. The hot gas bypass flow lowers the effective capacity of the compressor which reduces the cycling. Although the efficiency of the system may be somewhat reduced, a hot gas bypass provides a very simple yet effective solution to the cycling problem.

Varying condenser coolant temperature may also cause problems with a refrigeration system. When the temperature of the condenser's coolant drops, the pressure differential across the expansion device decreases. If the coolant temperature becomes too low, the rate of condensation may exceed the mass flow rate leaving the condenser through the expansion device. Under such conditions, liquid refrigerant will start accumulating in the condenser. The liquid level will begin rising and flood much of the condenser, raising the condensing temperature and pressure. This continues until the condenser's effectiveness to condense refrigerant is reduced to a point of equilibrium where the rate of condensation equals the mass flow rate passing through the expansion device.

A partially flooded condenser deprives an otherwise flooded evaporator of its liquid refrigerant. A low level of liquid refrigerant in the evaporator reduces its heat transfer effectiveness, and so the overall efficiency of the system is reduced. Moreover, many systems rely on a high level of liquid refrigerant in the evaporator to assure proper oil return to the compressor. A high liquid level filling the majority of the evaporator with liquid, leaves a relatively small volume for refrigerant vapor. The relatively small volume forces refrigerant vapor to first pass at relatively high velocity across the surface of the liquid refrigerant in the evaporator before entering the compressor. The high velocity across the liquid refrigerant promotes the vapor's ability to entrain oil which is dissolved in the liquid refrigerant.

Problems brought about by low condenser coolant temperatures can be aggravated during periods of high temperature conditioning demand. During such periods, the compressor may need to operate fully loaded, i.e., compressor output is at its maximum mass flow rate. An increase in compressor output, in addition to the expansion device's lower pressure differential (caused by a low condenser temperature), leads to further accumulation of liquid refrigerant in the condenser. In other words, the mass flow entering the condenser (compressor output) is greater than the mass flow leaving the condenser by way of the expansion device (under the impetus of a reduced pressure differential).

It should be clear that several problems need to be addressed when designing refrigeration systems that may be operating under varying conditions. More specifically, the problems that need to be solved include excessive cycling during low load conditions, inadequate oil return during low load conditions, condenser flooding due to low condenser coolant temperatures, condenser flooding due to high load conditions, inadequate oil return due to insufficient evaporator flooding, and reduced heat transfer efficiency due to insufficient evaporator flooding and excessive condenser flooding. Although each of the above problems might be addressed separately, it is an object of the invention to provide a single apparatus comprising a simple bypass line having a valve that is controlled to provide the necessary flow to solve all the above problems.

Another object of the invention is to take full advantage of the heat transfer surface of both the condenser and evaporator during low head and high load operating conditions by decreasing condenser flooding and increasing evaporator flooding by conveying liquid refrigerant directly from the condenser to the evaporator, bypassing the expansion device.

Another object of the invention is to position a bypass line in a refrigeration system such that it provides a means to control the liquid level in both the condenser and the evaporator and also provides a hot gas bypass.

Yet another object is to provide a bypass line that is connected above the lowest point on the condenser so that the line is able to pass either liquid or gas, depending on the liquid level in the condenser.

A further object of the invention is to provide a bypass valve that is controlled in response to low load and high liquid level in the condenser.

A still further object is to determine a high liquid level in the condenser by using low head and high load conditions as indicators.

Yet another object is to provide proper oil return to the compressor at low head/high load conditions by maintaining a proper level of liquid refrigerant in the evaporator so that before vaporous refrigerant enters the compressor, the vapor first passes through the evaporator at sufficiently high velocity to entrain oil at the surface of the liquid refrigerant.

Another object is to enhance oil return at low load conditions by strategically locating the outlet of the hot gas bypass below the liquid level in the evaporator.

Another object of the invention is to provide a variable capacity refrigeration system with both a variable capacity compressor and a hot gas bypass.

And another object is to provide a method of maintaining a proper level of liquid refrigerant in both the condenser and evaporator of a variable capacity refrigeration system having a fixed orifice for an expansion device.

These and other objects of the invention will be apparent from the attached drawings and the desription of the preferred embodiment that follows below.

SUMMARY OF THE INVENTION

The subject invention is a refrigeration apparatus that includes a condenser, an expansion device, and an evaporator, all connected in series. In addition, a bypass valve is connected between the condenser and the evaporator, in parallel with the expansion device. The bypass valve opens to convey excess liquid refrigerant from the condenser to the evaportor in response to a high level of liquid refrigerant in the condenser. The bypass valve also opens in response to a low load condition to convey vaporous refrigerant from the condenser to the evaporator. The purpose of the bypass valve is to provide a hot gas bypass during low load conditions and to conrol the level of liquid refrigerant in both the condenser and the evaporator.

DESCRIPTION OF THE PREFERRED EMBODIMENT

Figure 1:
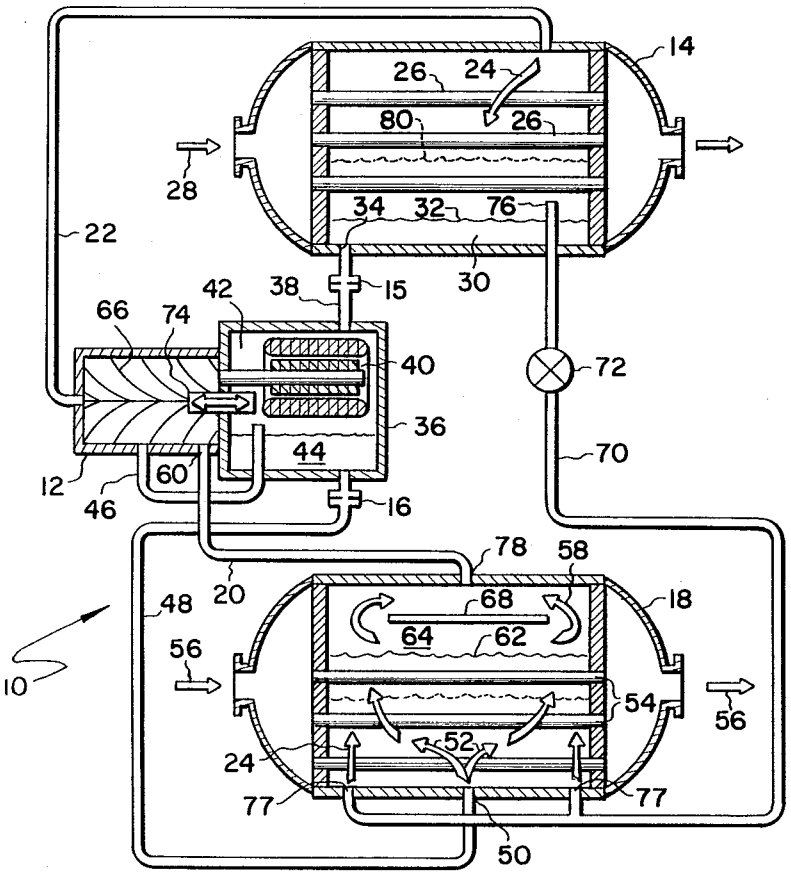
FIG. 1 illustrates a refrigeration apparatus incorporating the preferred embodiment of the invention.

The subject invention is incorporated in the refrigeration apparatus 10 shown in FIG. 1. Refrigeration apparatus 10 includes a screw compressor 12, a condenser 14, orifices 15 and 16, and a flooded evaporator 18, all connected in series.

In operation, compressor 12 draws in vaporous refrigerant through line 20 and discharges it through line 22. The discharged refrigerant 24 enters condenser 14 which is a conventional shell-and-tube heat exchanger. While in the condenser, the vaporous refrigerant 24 passes across the exterior of several heat exchanger tubes 26, and in the process, is cooled by a coolant 28 that is conveyed through the interior of tubes 26. The preferred coolant 28 is water but other fluids, such as air or brines, could also be used. The vaporous refrigerant 24 condenses as it cools and may accumulate as a liquid 30 at the bottom of condenser 14. The liquid level 32 of the accumulated refrigerant 30 is preferrably kept below tubes 26 for reasons that will be explained later. The liquid refrigerant 30 subsequently leaves condenser 14 through a condenser outlet 34.

Upon leaving the condenser, refrigerant 30 passes through orifice 15 which causes the refrigerant's pressure and temperature to drop before entering a compressor motor housing 36 via line 38. Once inside housing 36, the refrigerant cools the compressor's motor 40, and the resulting vaporized refrigerant 42 separates from the liquid refrigerant 44 as the liquid settles at the bottom of housing 36. The vaporized refrigerant 42 returns to compressor 12 at an intermediate stage of compression by way of line 46, while the liquid refrigerant 44 leaves housing 36 through orifice 16. Orifice 16 further reduces the refrigerant's pressure and temperature before it passes through line 48 and enters the bottom of evaporator 18 through evaporator inlet 50.

Evaporator 18 is a flooded shell-and tube heat exchanger having heat exchanger tubes 54 that are submerged in liquid refrigerant 52. Refrigerant 52 passes across the exterior surface of heat exchanger tubes 54, while a fluid, which is to be cooled by the refrigerant, is conveyed through the interior of tubes 54. The fluid, referred to hereinbelow as chilled water 56, is delivered from evaporator 18 to satisfy a temperature conditioning demand, e.g., to cool a building interior. Refrigerant 52 vaporizes as it absorbs heat from chilled water 56 and is drawn as a vapor 58 through line 20 and into a suction port 60 of compressor 12 to complete a refrigeration cycle.

For optimum efficiency and proper oil return to compressor 12, it is desirable to maintain evaporator 18 substantially flooded with liquid refrigerant 52 and condenser 14 substantially filled with vaporous refrigerant 24. Condenser 14 should have a refrigerant liquid level 32 that is below tubes 26 to maximize the tube surface area that is available to condense vaporous refrigerant 24. Evaporator 18, on the other hand, should be flooded with liquid refrigerant 52, because the coefficient of heat transfer between refrigerant 52 and chilled water 56 is greatest when the exterior surface of tubes 54 are wetted by liquid refrigerant.

In addition, a high liquid level 62 in evaporator 18 assists the vaporous refrigerant 58 in entraining oil to be returned to compressor 12. The high liquid level 62 leaves only a small volume 64 above it through which vapor 58 must pass before entering compressor 12. The small volume 64 forces vapor 58 to travel at a relatively high velocity. The high velocity enhances the vapor's ability to agitate and entrain liquid refrigerant 52 which carries some dissolved oil with it. It is especially, and even critically important in systems having a screw compressor that vapor 58 carries a significant portion of oil with it to provide the sealing and lubrication requied between the compressor's screw rotors 66. Therefore, evaporator 18 also includes a baffle 68 to further increase the vapor velocity across the liquid surface 62.

In regard to the more novel aspects of the invention, the refrigeration apparatus 10 includes a bypass line 70 having a bypass valve 72 that is controlled in response to certain operating conditions. For example, during periods of low temperature conditioning demand, refrigeration apparatus 10 responds by operating compressor 12 at less than full load, i.e., reducing the refrigerant output flow of the compressor. Operating in a low load condition is accomplished by repositioning the screw compressor's slide valve 74, the details of which are well known to those skilled in the art. If the compressor output is still more than what is required to satisfy the demand, bypass valve 72 opens momentarily to deliver relatively hot refrigerant vapor 24 from condenser 14 to evaporator 18. The bypass flow applies an internally created load that counteracts the relatively high compressor output to avoid frequent on/off cycling of the compressor. To assure a flow of hot vapor 24, as oppossed to liquid 30, the bypass inlet 76 is positioned above the normal liquid level 32. A predetermined low load condition requiring the opening of valve 72 can be identified as slide valve 74 reaching a predetermined position (FIGS. 3*h*–3*n*, line 101) or, as in the preferred embodiment, identified as the temperature of the chilled water 56 falling below predetermined lower limit. (FIGS. 3*a*–3*g*, 3*n* line 102)

Bypass line 70 includes at least one bypass outlet 77 strategically located on evaporator 18 to discharge generally downstream of evaporator inlet 50 for the specific purpose of enhancing oil return to compressor 12. As liquid refrigerant 52 travels through evaporator 18, downstream from inlet 50, the refrigerant's concentration of oil increases due to progressive vaporizing of the refrigerant. Discharging relatively hot vapor 24 at a high velocity into oil rich liquid refrigerant 52 assists cooler vapor 58 in entraining oil before exiting through evaporator outlet 78 and entering compressor 12.

Bypass valve 72 serves other functions during other operating conditions, such as when liquid refrigerant 30 accumulates in condenser 14 to a high liquid level 80. When liquid level 80 is above bypass inlet 76 and liquid refrigerant 30 begins flooding tubes 26, bypass valve 72 opens to drain the excess liquid 30 to evaporator 18, maintaining proper liquid levels in both the condenser and the evaporator. As mentioned earlier, maintaining the proper liquid levels takes full advantage of the heat transfer surfaces and assures a high vapor velocity in the evaporator to provide the compressor with sufficient oil return.

Condenser 14 can become flooded as a result of a low head condition, i.e., low pressure differential between the condenser and the evaporator. And a low head is often brought about by an excessively low temperature of condenser coolant 28. The problem of a flooded condenser is aggravated when the low coolant temperature occurs during high load conditions. Therefore, in the preferred embodiment of the invention, bypass valve 72 opens in response to the condenser coolant temperature dropping below a predetermined limit (FIGS. 3*d*, 3*k*, line 103 during a high load condition. The high load condition is identified as the temperature of the chilled water 56 remaining above a predetermined upper limit (FIGS. 3*a*–g, 3*n*, line 102) for more than a predetermined period of time. The actual values of the upper temperature limit and the period of time would depend on the specific refrigeration apparatus, and the period of time could be any predetermined value greater than or equal to zero. As an alternative, a high load condition can be identified as slide valve 74 reaching a. predetermined position (FIGS. 3*n*–3*n*, line 101) fully loaded condition.

Figure 3A:
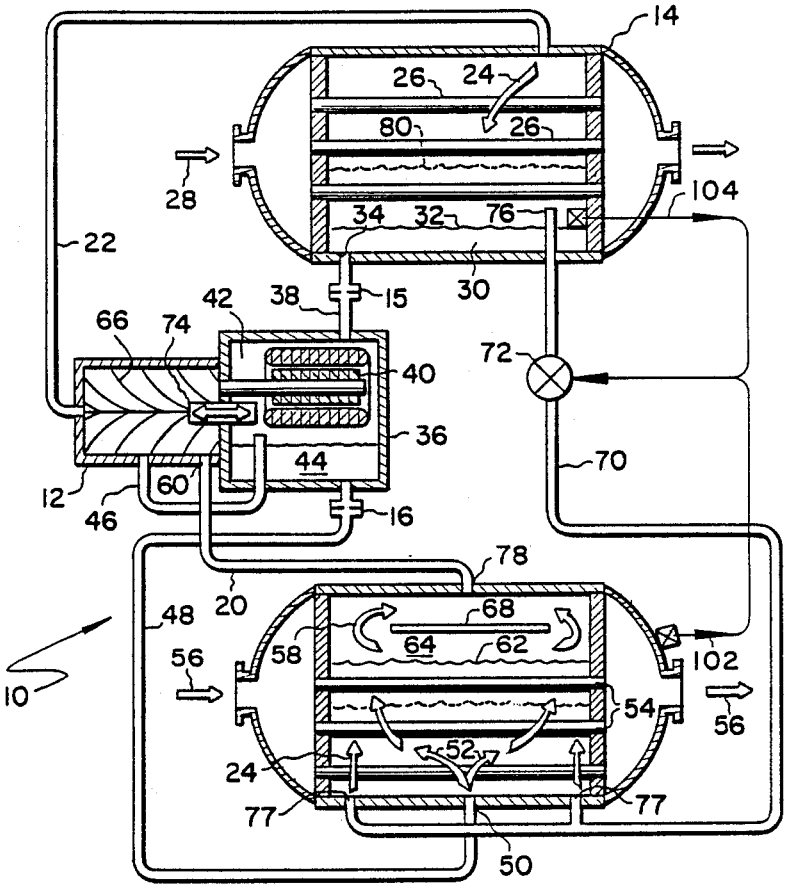
FIGS. 3*a–n* illustrate various embodiments of the invention and how different sensor combinations can be used to control a bypass valve in response to a predetermined high level of liquid refrigerant in a condenser and a predetermined low load condition.
Figure 3B:
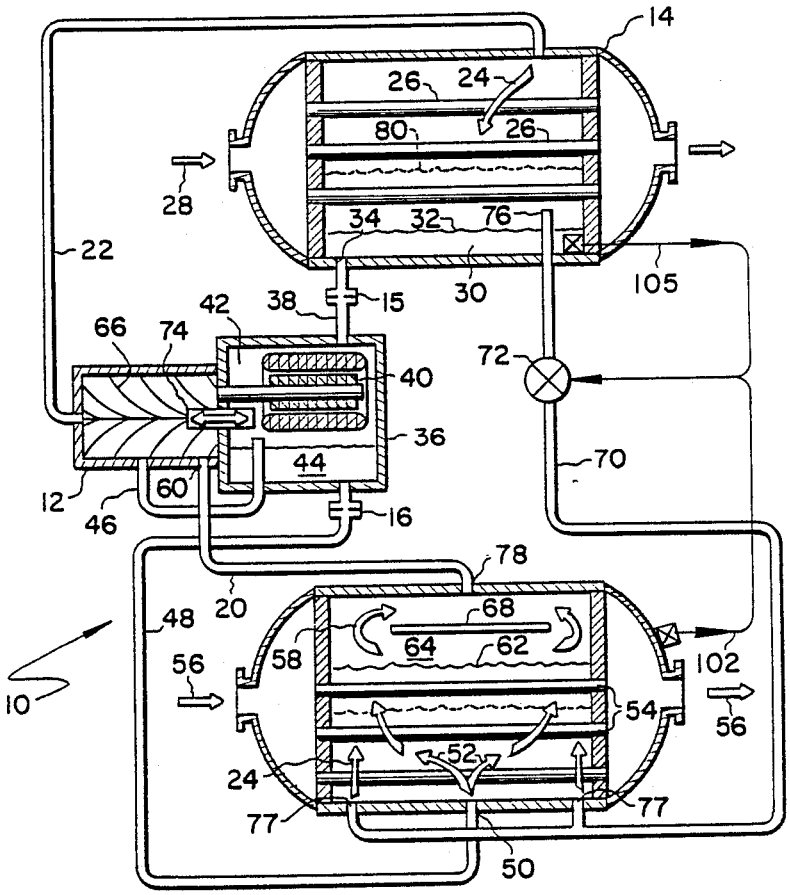
Figure 3C:
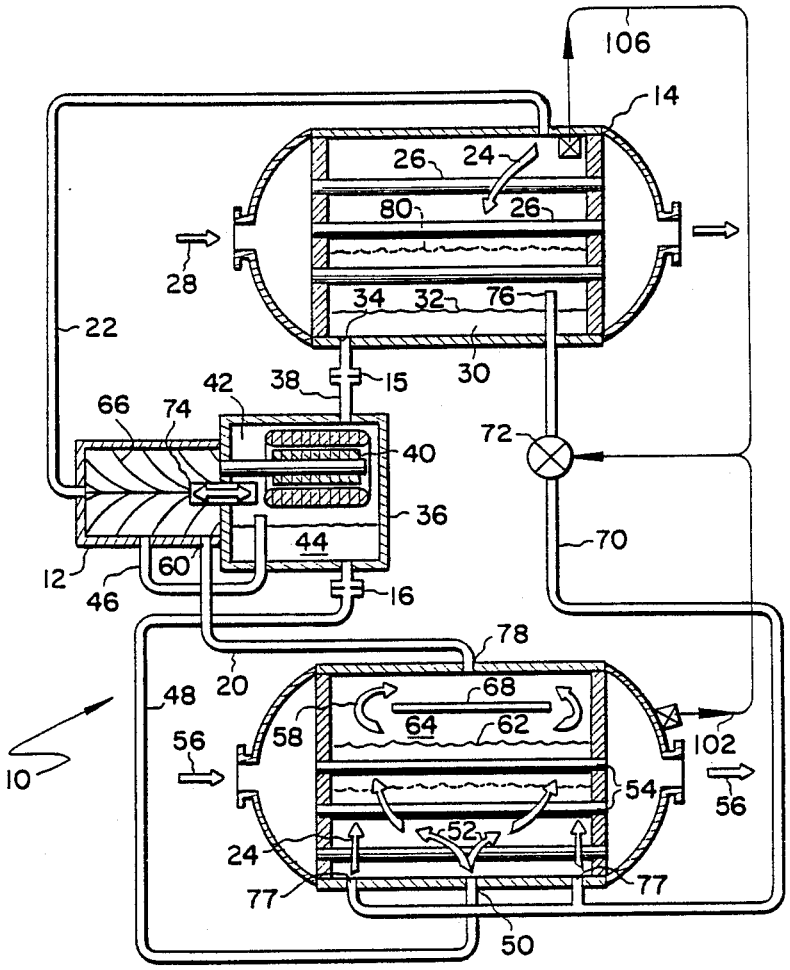
Figure 3D:
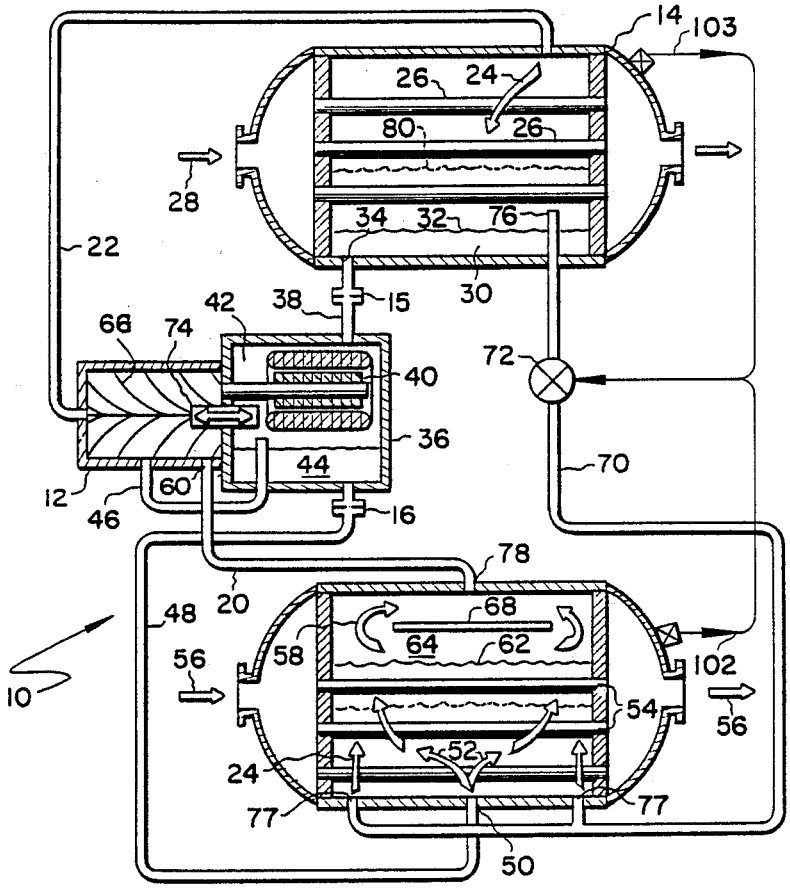
Figure 3E:
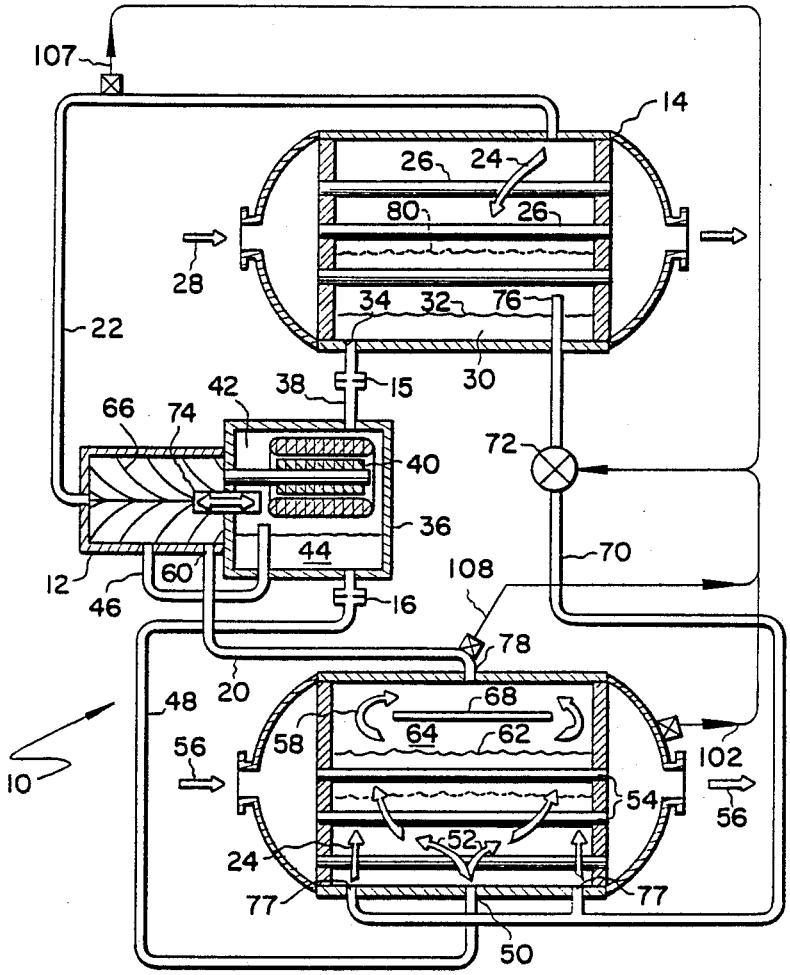
Figure 3F:
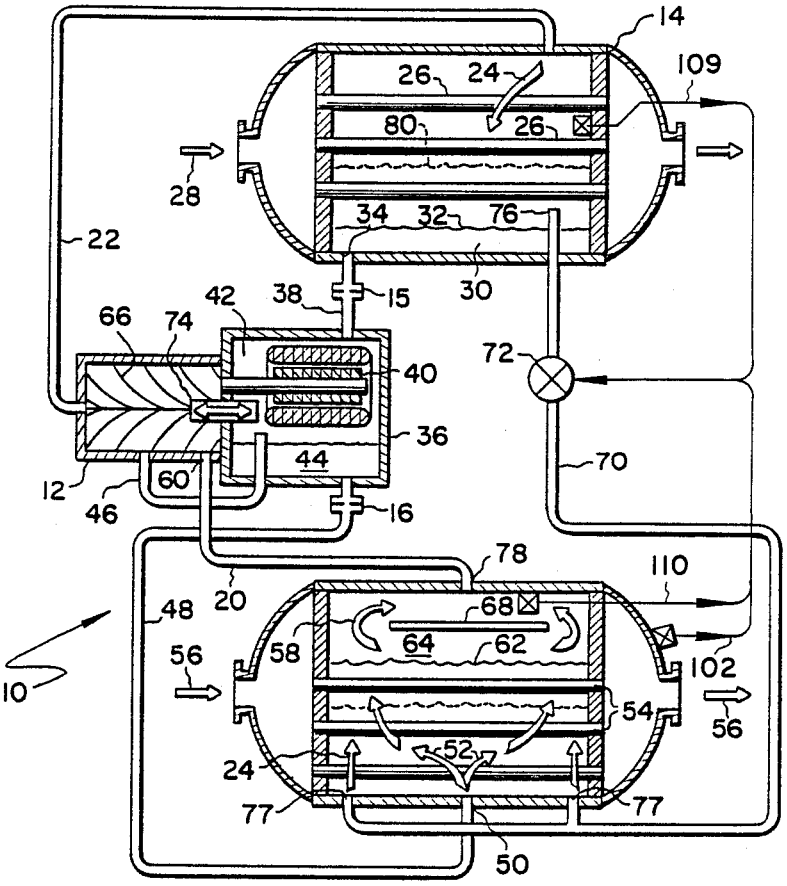
Figure 3G:
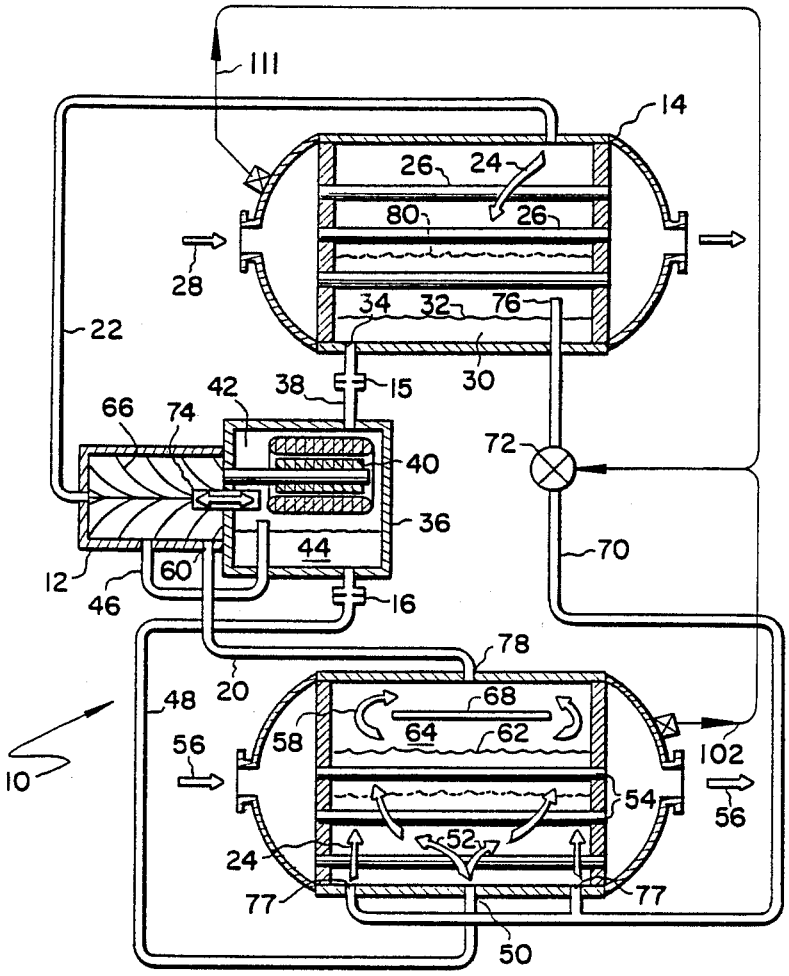
Figure 3H:
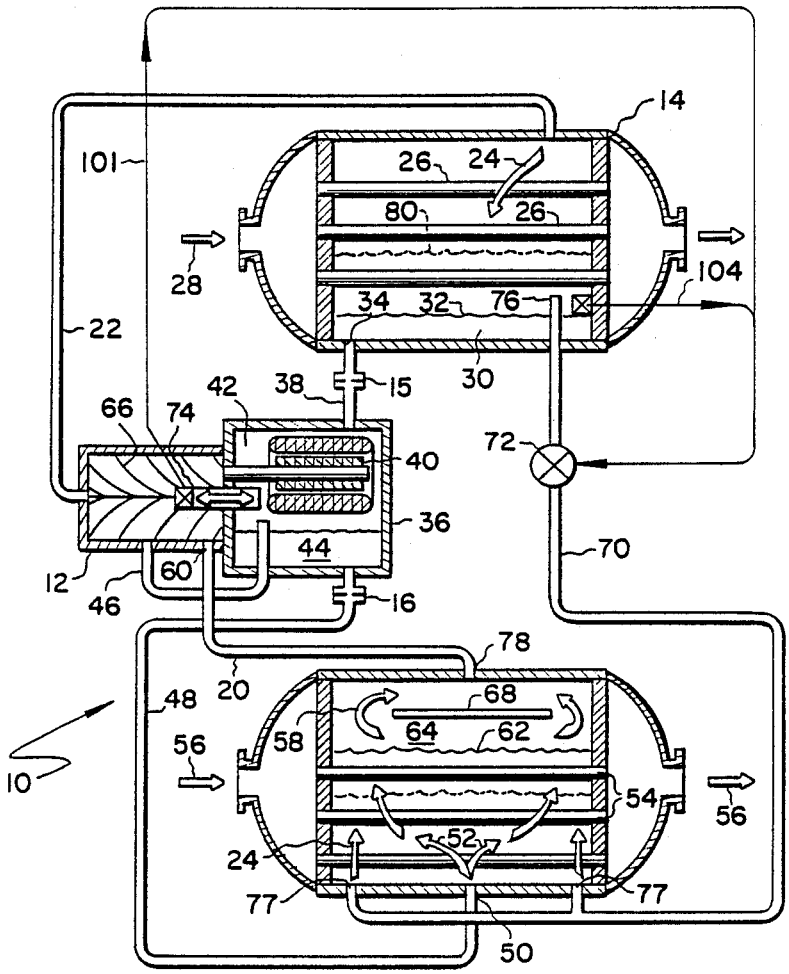
Figure 31:
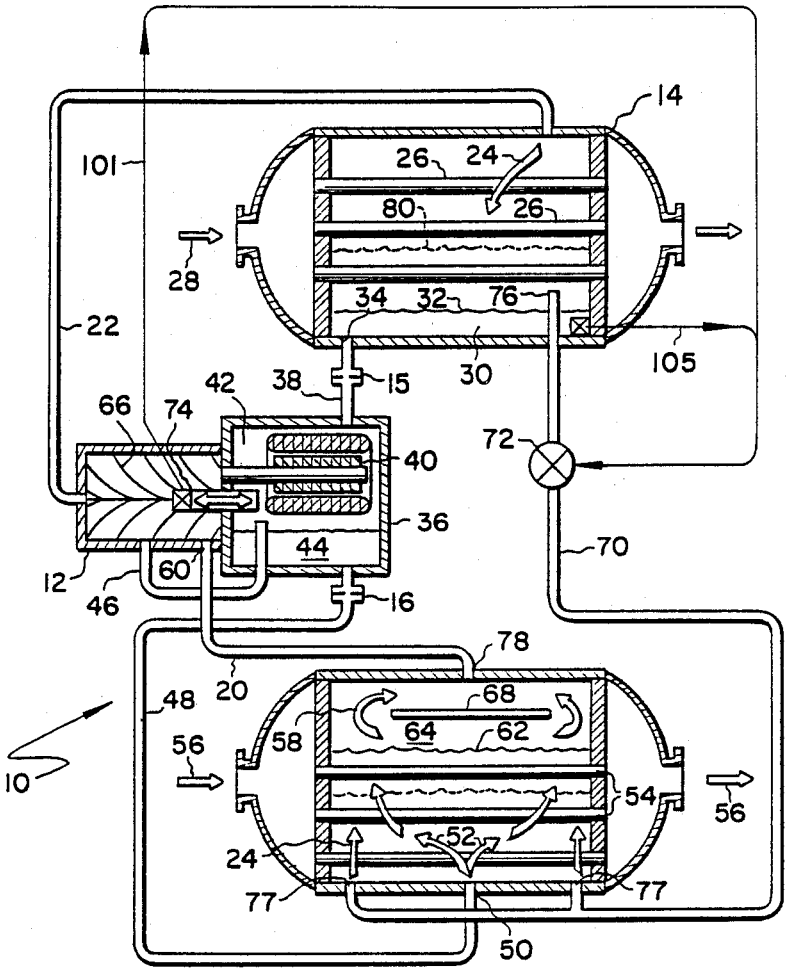
Figure 3J:
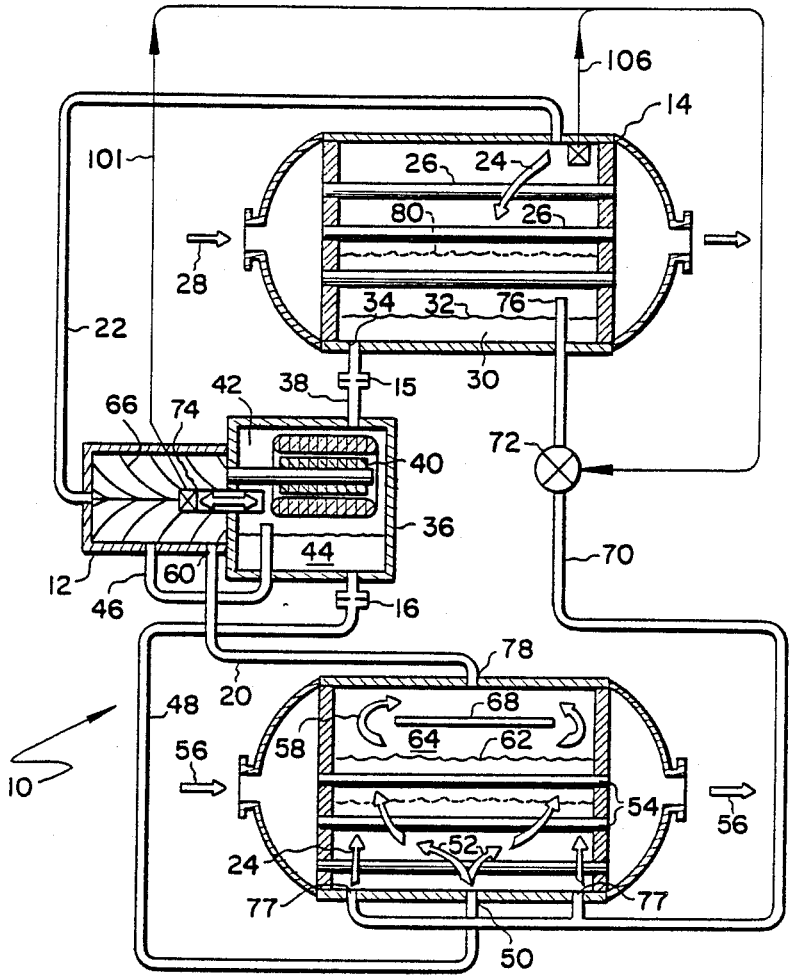
Figure 3K:
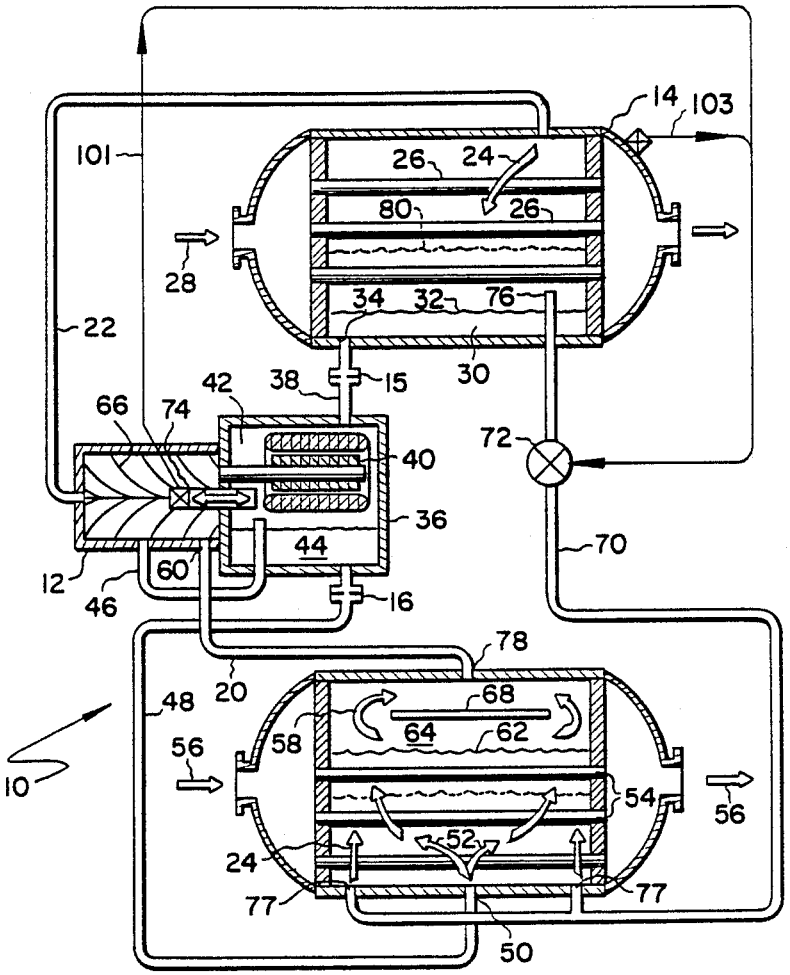
Figure 31:
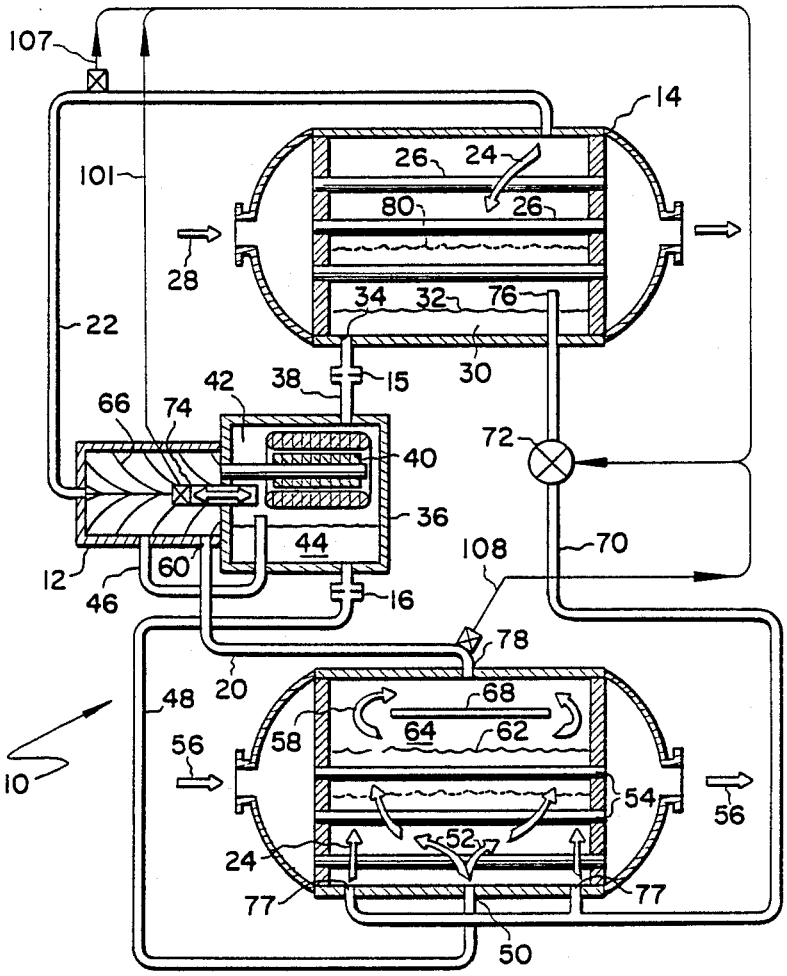
Figure 3M:
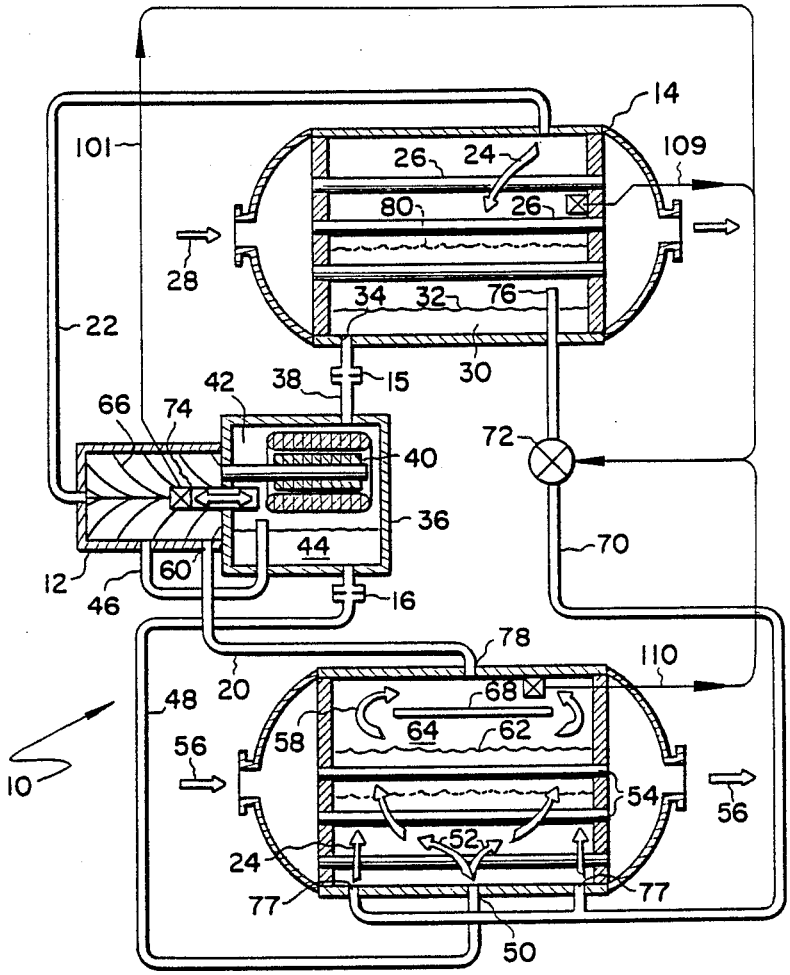
Figure 3N:
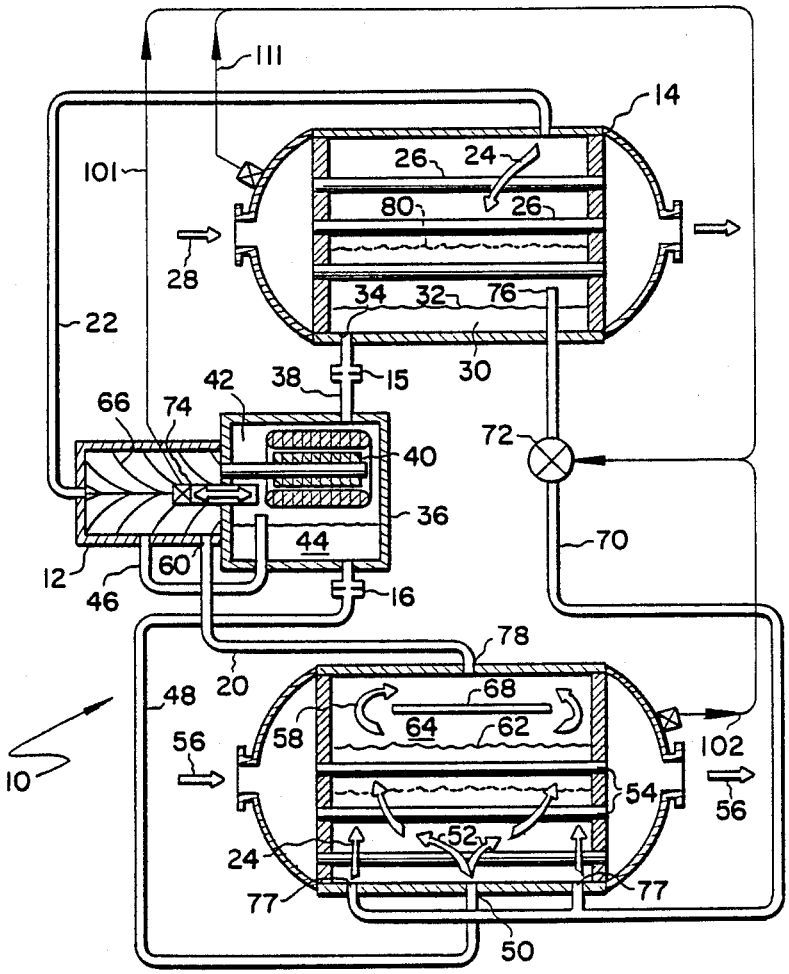
Figure 4:
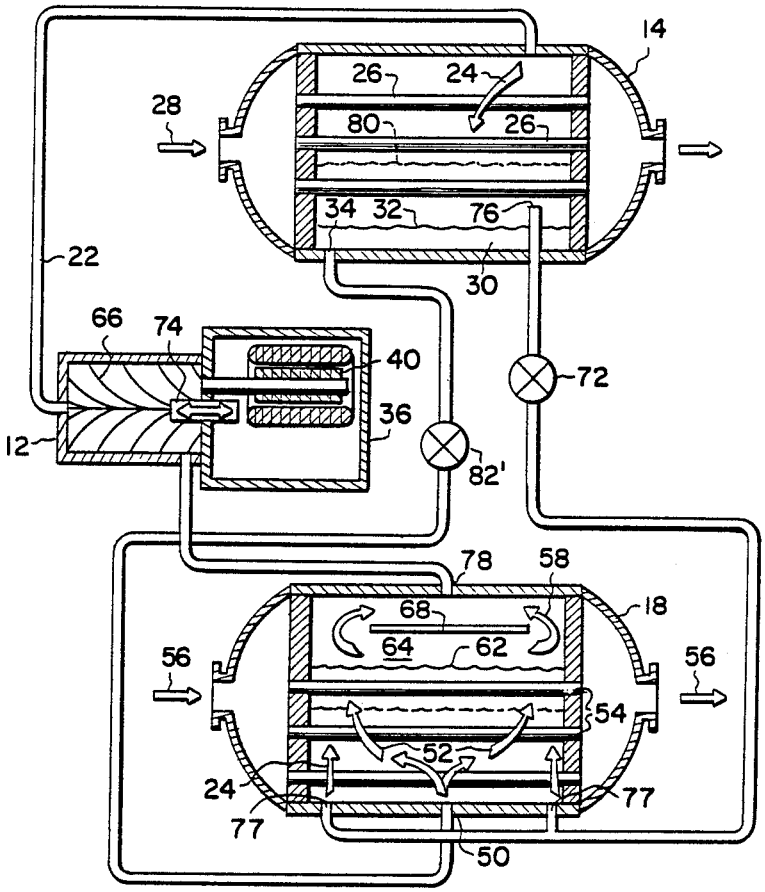
FIG. 4 illustrates a variable opening expansion valve as an alternative to a fixed orifice.

A more direct indicator of a high level 80 of liquid refrigerant 30 in condenser 14 would be a float switch mounted. inside the condenser (FIGS. 3*a*, 3*n*, line 104). Due to the costs involved in mounting a switch inside a hermetic shell, the use of other less direct indicators of a high liquid level 80 are preferred. For example, in the preferred embodiment of the invention, the indicator is an occurrence of a predetermined thermodynamic condition characteristic of a low head. In particular, the thermodynamic condition is the temperature of the refrigerant in condenser 14 falling below a predetermined temperature limit (FIGS. 3*b*, 3*i*, line 105. Other examples of predetermined thermodynamic conditions characteristic of a low head include, but are not limited to, the following:

1. The pressure of the refrigerant in the condenser falling below a predetermined limit (FIGS. 3*c*, 3*j*, line 106).
2. The temperature of the condenser coolant 28 falling below a predetermined limit (FIGS. 3*d*, 3*k*, line 103.
3. The pressure differential across either the compressor, across the expansion device, or between the condenser and evaporator falling below a predetermined limit (FIGS. 3*e*, 3*l*, line 107 and 108).
4. The temperature difference between the saturated temperature of the refrigerant in condenser 14 minus its saturated temperature in evaporator 18 falling below a predetermined limit (FIGS. 3*f*, 3*n*, lines 109 and 110)
5. The temperature differential of coolant 28. entering condenser 14 (FIGS. 3*g*. 3*n*, line 111) minus chilled water 56 leaving evaporator 18 falling below a predetermined limit (FIGS. 3*a*–3*g*, 3*n*, line 102.

Figure 2:
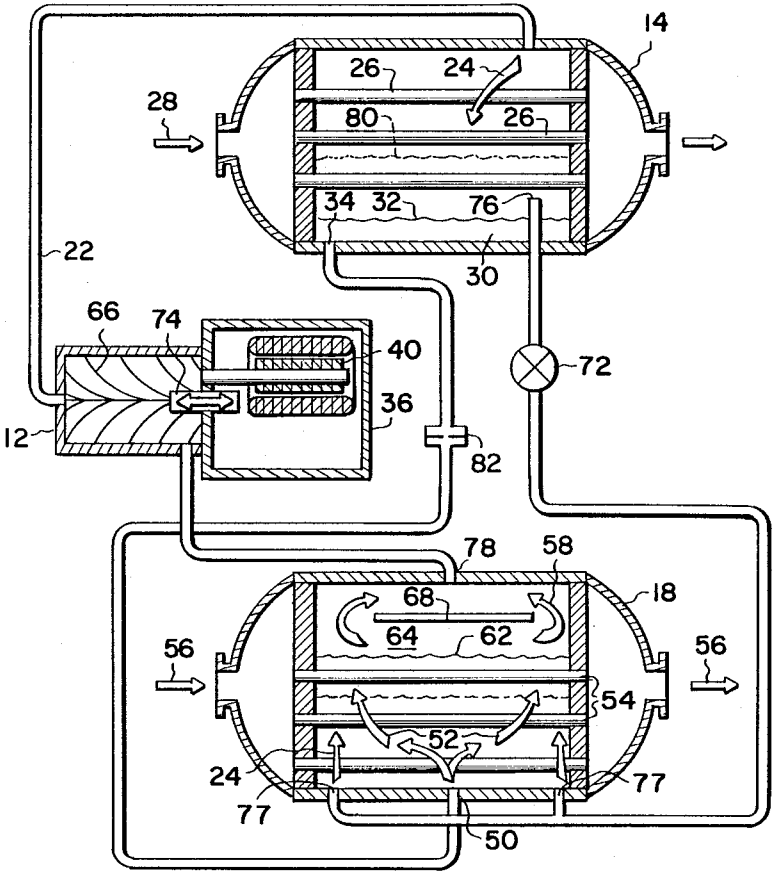
FIG. 2 illustrates another embodiment of the invention.

Another, less complicated embodiment of the invention is shown in FIG. 2. It differs from the preferred embodiment in that the means for cooling motor 40 and separating the liquid from the vapor within motor housing 36 have been eliminated. As a result only one expansion device 82 is required. In other respects, the operation of both embodiments are essentially the same.

It should be noted that lines 101–111 represent only a sample of the many possible sensor connections. In addition, no single embodiment of the invention should require all of the line connects shown, but instead, line connections 101–111 provide a composite set from which numerous combinations may be selected to carry out the invention.

It should be noted that further modifications to the embodiments can be made while still remaining within the scope of the invention. For example, compressor 12 could be any type of variable capacity compressor, expansion devices 15, 16 and 82 could each be a capillary tube or a variable opening expansion valve, and bypass valve 72 could be a variable opening valve to provide modulated control rather than two-position open/closed control. It should be appreciated that further modifications will be apparent to those skilled in the art. Therefore, the scope of the invention is to be determined by reference to the claims which follow.

We claim:

1. A refrigeration apparatus comprising a condenser, an expansion device, and an evaporator connected in series, and including a bypass valve connected in parallel with said expansion device and in series with both said condenser and said evaporator, said bypass valve opening to convey liquid refrigerant in response to a predetermined indicator of a high level of liquid refrigerant in said condenser and opening to convey vaporous refrigerant in response to a predetermined low load condition.

2. The refrigeration apparatus as recited in claim 1, wherein said expansion device is an orifice having a fixed opening.

3. The refrigeration apparatus as recited in claim 1, wherein said expansion device is an expansion valve having a variable opening.

4. The refrigeration apparatus as recited in claim 1, wherein said bypass valve is a two position valve having an open position and a closed position.

5. The refrigeration apparatus as recited in claim 1, wherein the extent of opening of said bypass valve is variable to provide modulated flow therethrough.

6. The refrigeration apparatus as recited in claim 1, further comprising a variable capacity compressor selectively operative in a loaded and an unloaded condition and having a refrigerant flow output rate that is greater when loaded than unloaded.

7. The refrigeration apparatus as recited in claim 6, wherein said compressor is a screw compressor having a slide valve whose position determines whether said compressor is operating loaded or unloaded.

8. The refrigeration apparatus as recited in claim 6, further comprising a compressor motor housing having a housing inlet and a housing outlet for conveying refrigerant through said housing, in parallel with said bypass valve, and in series with said expansion device said housing outlet being positioned near the bottom of said housing to facilitate the separation of liquid refrigerant from vaporous refrigerant.

9. The refrigeration apparatus as recited in claim 1, wherein said condenser is substantially filled with vaporous refrigerant and includes a condenser outlet for discharging refrigerant in series flow through said expansion device, and wherein said evaporator is substantially flooded with liquid refrigerant and includes an evaporator inlet for receiving refrigerant in series flow relationship with said expansion device.

10. The refrigeration apparatus as recited in claim 9, wherein said bypass valve is disposed in a bypass line having a bypass inlet connected to said condenser at a higher elevation then said condenser outlet.

11. The refrigeration apparatus as recited in claim 1, wherein said predetermined low load condition is when the temperature of a chilled fluid passing through said evaporator is below a predetermined lower limit.

12. The refrigeration apparatus as recited in claim 11, wherein said predetermined low load condition is when the temperature of a chilled fluid passing through said evaporator is below a predetermined lower limit for a predetermined period.

13. The refrigeration apparatus as recited in claim 7, wherein said predetermined low load condition is when said slide valve reaches a predetermined position.

14. The refrigeration apparatus as recited in claim 1, wherein said predetermined indicator of a high level of liquid refrigerant in said condenser is the occurrence of a predetermined thermodynamic condition characteristic of a low head condition.

15. The refrigeration apparatus as recited in claim 14, wherein said predetermined indicator of a high level of liquid refrigerant in said condenser is said predetermined thermodynamic condition occurring during a predetermined high load condition.

16. The refrigeration apparatus as recited in claim 15, wherein said predetermined high load condition is characterized by the temperature of a chilled fluid passing through said evaporator exceeding a predetermined upper temperature limit.

17. The refrigeration apparatus as recited in claim 16, wherein said predetermined high load condition is characterized by the temperature of a chilled fluid passing through said evaporator exceeding a predetermined upper temperature limit for a predetermined period.

18. The refrigeration apparatus as recited in claim 15, wherein said predetermined high load condition is characterized by a slide valve of a screw compressor reaching a predetermined position.

19. A refrigeration apparatus comprising:

(a) a variable capacity compressor selectively operative in a loaded and an unloaded condition with a refrigerant flow output rate of said compressor being greater when loaded than unloaded;

(b) a condenser being substantially filled with vaporous refrigerant and having a condenser outlet for discharging refrigerant in series flow through an expansion device;

(c) an evaporator being substantially flooded with liquid refrigerant and including an evaporator inlet for receiving refrigerant in series flow relationship with said expansion device, said compressor, condenser, expansion device, and evaporator all being connected in series flow relationship;

(d) a bypass line connected in parallel with said expansion device, said bypass line having a bypass inlet connected to said condenser at a higher elevation than said condenser outlet and having a bypass outlet connected to said evaporator; and (e) a bypass valve disposed in said bypass line, said valve opening in response to a predetermined low load condition and opening in response to a predetermined indicator of a high level of liquid refrigerant in said condenser, whereby said bypass line in conjunction with said bypass valve controls the level of liquid refrigerant in said condenser and provides a hot gas bypass during low load conditions.

20. The refrigeration apparatus as recited in claim 19, wherein said expansion device is an orifice having a fixed opening.

21. The refrigeration apparatus as recited in claim 19, wherein said expansion device is an expansion valve having a variable opening.

22. The refrigeration apparatus as recited in claim 19, wherein said bypass valve is a two position valve having an open position and a closed position.

23. The refrigeration apparatus as recited in claim 19, wherein the extent of opening of said bypass valve is variable to provide modulated flow therethrough.

24. The refrigeration apparatus as recited in claim 19, wherein said compressor is a screw compressor having a slide valve whose position determines whether said compressor is operating loaded or unloaded.

25. The refrigeration apparatus as recited in claim 19, further comprising a compressor motor housing having a housing inlet and a housing outlet for conveying refrigerant through said housing in parallel with said bypass valve, and in series with said expansion device said housing outlet being located near the bottom of said housing to separate liquid refrigerant from vaporous refrigerant.

26. The refrigeration apparatus as recited in claim 19, wherein said predetermined low load condition is when the temperature of a chilled fluid passing through said evaporator is below a predetermined lower limit.

27. The refrigeration apparatus as recited in claim 26, wherein said predetermined low load condition is when the temperature of a chilled fluid passing through said evaporator is below a predetermined lower limit for a predetermined period.

28. The refrigeration apparatus as recited in claim 24, wherein said predetermined low load condition is when said slide valve reaches a predetermined position.

29. The refrigeration apparatus as recited in claim 19, wherein said predetermined indicator of a high level of liquid refrigerant in said condenser is the occurrence of a predetermined thermodynamic condition characteristic of a low head condition.

30. The refrigeration apparatus as recited in claim 29, wherein said predetermined indicator of a high level of liquid refrigerant in said condenser is said predetermined thermodynamic condition occurring during a predetermined high load condition.

31. The refrigeration apparatus as recited in claim 30, wherein said predetermined high load condition is characterized by the temperature of a chilled fluid pasing through said evaporator exceeding a predetermined temperature limit.

32. The refrigeration apparatus as recited in claim 31, wherein said predetermined high load condition is characterized by the temperature of a chilled fluid passing through said evaporator exceeding a predetermined temperature limit for a predetermined period.

33. The refrigeration apparatus as recited in claim 30, wherein said predetermined high load condition is characterized by a slide valve of a screw compressor reaching a predetermined position.

34. A refrigeration apparatus comprising:

(a) a variable capacity screw compressor having a slide valve whose position controls said compressor to operate between a loaded and an unloaded condition, said compressor having a refrigerant flow output rate that is greater when loaded than unloaded to meet a varying temperature conditioning demand;

(b) a condenser having a greater volume of vaporous refrigerant than liquid refrigerant and having a condenser outlet for discharging refrigerant in series flow through an orifice having a fixed opening;

(c) a flooded evaporator having a plurality of heat exchanger tubes substantially submerged in liquid refrigerant and including an evaporator inlet for receiving refrigerant in series flow relationship with said orifice, said compressor, condenser, orifice, and evaporator all being connected in series flow relationship;

(d) a bypass line connected in parallel with said orifice, said bypass line having a bypass inlet connected to said condenser at a higher elevation than said condenser outlet and having a bypass outlet connected to said evaporator; and (e) a bypass valve disposed in said bypass line, said valve opening in response to a predetermined low load condition and opening in response to a predetermined thermodynamic condition characteristic of a low head.

35. The refrigeration apparatus as recited in claim 34, wherein said predetermined thermodynamic condition characteristic of a low head is the temperature of said refrigerant in said condenser falling below a predetermined temperature limit.

36. The refrigeration apparatus as recited in claim 34, wherein said predetermined thermodynamic condition characteristic of a low head is the pressure of said refrigerant in said condenser falling below a predetermined pressure limit.

37. The refrigeration apparatus as recited in claim 34, wherein said predetermined thermodynamic condition characteristic of a low head is the temperature of a condenser coolant falling below a predetermined temperature limit.

38. The refrigeration apparatus as recited in claim 34, wherein said predetermined thermodynamic condition characteristic of a low head is a pressure differential between said condenser and said evaporator falling below a predetermined limit.

39. The refrigeration apparatus as recited in claim 34, wherein said predetermined thermodynamic condition characteristic of a low head is a temperature differential of the temperature of said vaporous refrigerant in said condenser minus the temperature of said liquid refrigerant in said evaporator falling below a predetermined limit.

40. The refrigeration apparatus as rectied in claim 34, wherein said predetermined thermodynamic condition characteristic of a low head is a temperature differential of a condenser coolant entering said condenser minus a chilled fluid leaving said evaporator falling below a predetermined limit.

* * * * *

UNITED STATES PATENT AND TRADEMARK OFFICE

CERTIFICATE OF CORRECTION

PATENT NO. : 4,832,068

DATED : May 23, 1989

INVENTOR(S) : James C. Wendschlag and James W. Larson

It is certified that error appears in the above-identified patent and that said Letters Patent is hereby corrected as shown below:

Column 5, line 34, after "103" insert --)--.

Column 5, line 44, "FIGS. 3n-3n" should read --FIGS. 3h-3n--.

Column 5, line 45, after "101)" insert --that places compressor 12 in a generally--.

Column 5, line 48, "FIGS. 3a, 3n" should read -- FIGS. 3a, 3h--.

Column 5, line 57, after "105" insert --)--.

Column 5, line 65, after "103" insert --)--.

Column 6, line 6, "3n" should read --3m--.

Column 6, lines 19-25 should be deleted.

Signed and Sealed this

Twenty-third Day of January, 1990

*Attest:*

JEFFREY M. SAMUELS

*Attesting Officer* *Acting Commissioner of Patents and Trademarks*